US009148714B2

(12) United States Patent
Zhao

(10) Patent No.: US 9,148,714 B2
(45) Date of Patent: Sep. 29, 2015

(54) BATTERY-POWERED SOUND DEVICE WITH MOUNTING ELEMENT MADE OF VIBRATION ABSORBING MATERIAL

(71) Applicants: Hao Bo Zhao, Nanshan District, Shenzhen (CN); ADD-ON TECHNOLOGY CO. LTD., Taipei (TW)

(72) Inventor: Hao Bo Zhao, Shenzhen (CH)

(73) Assignee: ADD-ON TECHNOLOGY, CO. LTD., Taipei (TW)

( * ) Notice: Subject to any disclaimer, the term of this patent is extended or adjusted under 35 U.S.C. 154(b) by 185 days.

(21) Appl. No.: 14/011,282

(22) Filed: Aug. 27, 2013

(65) Prior Publication Data

US 2014/0064535 A1 Mar. 6, 2014

(30) Foreign Application Priority Data

Aug. 28, 2012 (CN) ..... 2012 2 0430437 U

(51) Int. Cl.
*H04R 1/02* (2006.01)
*H04R 1/28* (2006.01)

(52) U.S. Cl.
CPC ..... *H04R 1/02* (2013.01); *H04R 1/021* (2013.01); *H04R 1/288* (2013.01); *H04R 2420/07* (2013.01)

(58) Field of Classification Search
CPC ..... H04R 5/02; H04R 1/025; H04R 1/026; H04R 1/02; H04R 2499/11
USPC ..... 381/332
See application file for complete search history.

(56) References Cited

U.S. PATENT DOCUMENTS

| | | | | |
|---|---|---|---|---|
| 7,469,053 | B2 * | 12/2008 | Langberg | 381/388 |
| 8,085,962 | B2 * | 12/2011 | Subramaniam et al. | 381/332 |
| 8,189,849 | B2 * | 5/2012 | Waddell et al. | 381/388 |
| 2014/0079264 | A1 * | 3/2014 | Minarik et al. | 381/332 |
| 2014/0140556 | A1 * | 5/2014 | Yim et al. | 381/332 |

* cited by examiner

*Primary Examiner* — Mark Blouin
(74) *Attorney, Agent, or Firm* — Workman Nydegger

(57) ABSTRACT

A sound device includes: at least one speaker (1-1), a speaker body (1) including the at least one speaker (1-1), and a sleeve (2) made of vibration absorbing material, wherein the sleeve (2) includes a first portion (2-2) shaped for housing the speaker body (1) and a second portion (2-1) shaped for forming a mounting element, and wherein the first portion (2-2) and second portion (2-1) of the sleeve (2) are integrally formed.

9 Claims, 2 Drawing Sheets

BATTERY-POWERED SOUND DEVICE WITH MOUNTING ELEMENT MADE OF VIBRATION ABSORBING MATERIAL

CROSS-REFERENCE TO RELATED APPLICATIONS

This application claims the priority of Chinese Utility Model No. 201220430437.5, filed on Aug. 28, 2012, which is incorporated herein by specific reference.

TECHNICAL FIELD

The present invention relates to a sound device, and more particularly, a battery-powered sound device with a mounting element. In a particular embodiment, the mounting element is made of vibration absorbing material.

BACKGROUND OF INVENTION

Most battery-powered speakers in the market are relatively small in size and light in weight. To adapt to the needs of the market, the power of these battery-powered speakers is designed to be larger and larger, and sometimes it becomes even larger than the speaker body's own weight. This causes vibrations and movements of the speaker when the speaker is in use, thereby significantly deteriorating the speaker performance.

SUMMARY OF INVENTION

To alleviate the problems aforementioned, the present invention provides a sound device comprising:

at least one speaker;

a speaker body comprising said at least one speaker;

a sleeve made of vibration absorbing material;

wherein said sleeve comprises a first portion shaped for housing said speaker body and a second portion shaped for forming a mounting element;

and wherein said first portion and second portion of said sleeve are integrally formed.

The intended advantage of the present utility model, in one aspect, is to achieve the object of fixing the speaker body by attaching an elastic suction cup of the sleeve onto any surface based on the working principle of atmospheric pressure. This avoids vibrations or movements of the speaker body caused by excessive power supply and thus enhances the practicality of the sound device.

In another aspect, the sleeve made of vibration absorbing material significantly reduces noises and vibrations.

BRIEF DESCRIPTION OF THE DRAWINGS

Such objects are achieved by the present invention through a sound device incorporating the features set out in the appended claims, which are intended to be an integral part of the present description. Further objects, features and advantages of the present invention will become apparent from the following detailed description and from the annexed drawings, which are supplied by way of non-limiting example, wherein:

DETAILED DESCRIPTION OF THE PREFERRED EMBODIMENTS

Figure 1:
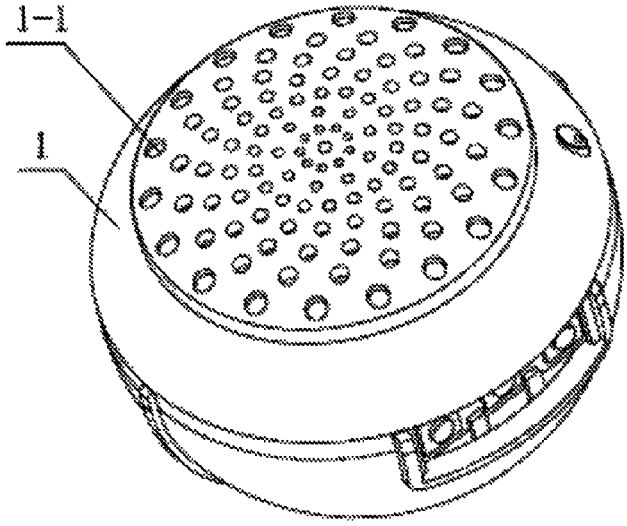
FIG. 1 illustrates the structure of the speaker body of the present invention.

As shown in the figures, the present embodiment relates to a battery-powered sound device with a mounting element, which comprises a speaker body (1) and a sleeve (2). The battery-powered sound device contains built-in battery pack or other power supplying apparatus and preferably said sound device is able to operate properly without connecting to external power supply. The built-in battery pack or other power source can be replaceable or rechargeable. In the embodiment illustrated in FIG. 1, a socket for recharging the built-in battery is accessible through a control panel positioned on the external portion of the speaker body (1), in particular on the circumference of said speaker body (1). The speaker body (1) comprises upper and lower enclosures, in particular made of plastic material. The speaker body (1) also comprises holes on the top of the upper enclosure. While the speaker body (1) is spherical in the present embodiment, the appearance of speaker body (1) can be made into any shape based on actual needs; the speaker (1-1) is placed near the top of the speaker body (1).

Figure 2:
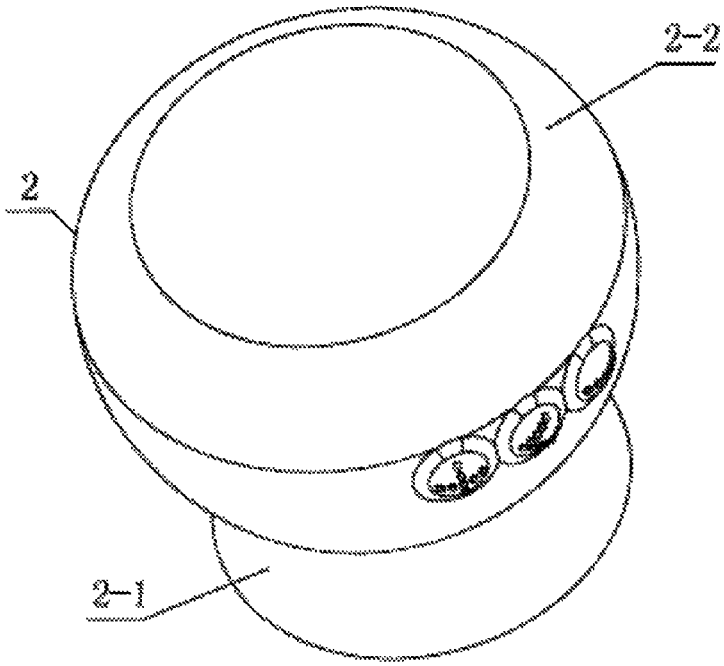
FIG. 2 illustrates the structure of the sleeve of the present invention.

As shown in FIG. 2, the sleeve (2) comprises a first portion (2-2) shaped for housing said speaker body (1) and a second portion (2-1) shaped for forming a mounting element, wherein said first portion (2-2) and second portion (2-1) of said sleeve (2) are integrally formed. In particular, the sleeve (2) comprises an elastic suction cup (2-1) on one end, which is connected to a speaker body housing (2-2) on the other end of the sleeve (2). To make mounting more convenient, said elastic suction sup (2-1) is located at the bottom of the sleeve (2) in the present embodiment. Said speaker body housing (2-2) of the sleeve (2) is a soft plastic case. It is a property of elastic plastic material such as silicon or the like, to significantly reduce noise and vibration.

The inner diameter of the speaker body housing (2-2) of the sleeve (2) substantially corresponds to the outer diameter of the enclosures of the speaker body (1). There is at least one matching protrusion on the external portion, in particular on the circumference, of the speaker body housing (2-2) of the sleeve (2), said at least one protrusion corresponding to the position of at least one control button on the speaker body (1).

According to the present embodiment, said at least one control button mounted on the speaker body housing (2-2) comprises volume adjustment buttons and/or a switch for power control. Preferably, the sound device according to the present invention is provided with a user interface comprising a control panel said at least one control button. In particular, said control panel comprises buttons for volume adjustment and/or a switch for power control and/or said socket for recharging said power source. It is common that for such user interface to also comprise other elements, such as (for example) a light emitting diode (LED) or a microphone.

In the embodiment illustrated in the figures, the sound device does not comprise a wired interface. Indeed, the speaker body comprises a signal transceiver (not shown) which is configured for receiving sound signals wirelessly and transferring such sound signals to the sound speaker (1-1). Such signal transceiver can operate using well known protocols, such as (for example) WiFi, Bluetooth or the like. However, it is clear that the sound device according to the present invention may also comprise a wired connection (not shown in the drawings) for receiving sound signals and transferring said sound signals to the speaker (1-1).

Figure 3:
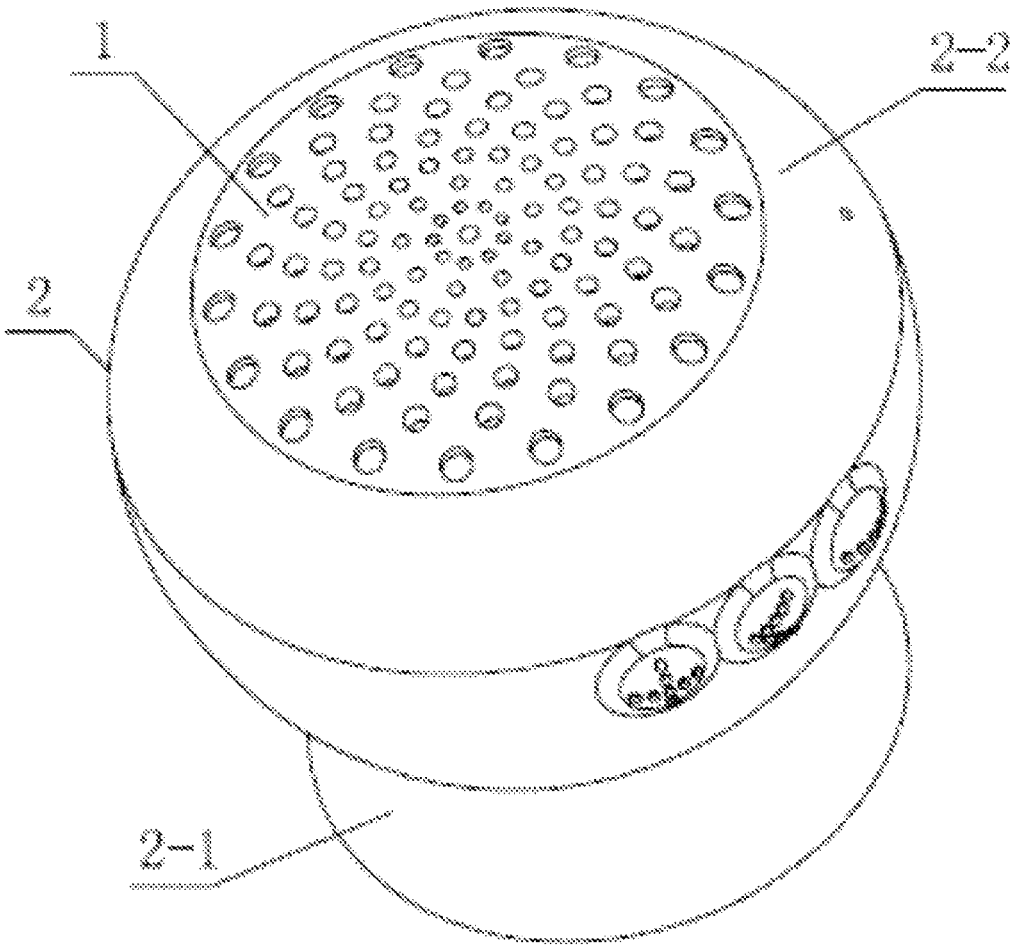
FIG. 3 illustrates the fully-assembled sound device of the present invention.

As shown in FIG. 3, the speaker body housing (2-2) of the sleeve (2) is wrapped around the speaker body (1) tightly so that the sleeve and the speaker body (1) are connected to each other, forming an integrated structure. To ensure quality of sound propagation, said speaker (1-1) is located near the top of the speaker body (1) so that the speaker (1-1) is not covered by the speaker body housing (2-2) of the sleeve (2). Such arrangement also leaves the holes formed in the speaker body (1) exposed to the atmosphere for propagation of sound.

It is therefore clear that the sound device (1) according to the present invention is easy to use, simply attaching the elastic suction cup (2-1) onto any surfaces to fix the speaker body (1) for the enjoyment of using an anti-vibration and movement-free speaker.

The sound device (1) described herein by way of example may be subject to many possible variations without departing from the novelty spirit of the inventive idea; it is also clear that in the practical implementation of the invention the illustrated details may have different shapes or be replaced with other technically equivalent elements. It can therefore be easily understood that the present invention is not limited to the above-described sound device, but may be subject to many modifications, improvements or replacements of equivalent parts and elements without departing from the inventive idea, as clearly specified in the following claims.

What is claimed is:

1. A sound device comprising:

at least one speaker;

a speaker body comprising said at least one speaker;

a sleeve made of vibration absorbing material;

wherein said sleeve comprises a first portion shaped for housing said speaker body and a second portion shaped for forming a mounting element; and wherein said first portion and second portion of said sleeve are integrally formed.

2. A device according to claim 1, wherein said speaker body further comprises:

speaker body holes;

a power source;

a user interface;

at least one built-in microphone; and at least one signal transceiver.

3. A device according to claim 2, wherein said user interface comprises a control panel with at least one control button.

4. A device according to claim 3, wherein said control panel comprises buttons for volume adjustment and/or a switch for power control and/or a socket for recharging said power source.

5. A device according to claim 4, wherein said control panel is positioned on the external portion of said speaker body, in particular on the circumference of said speaker body.

6. A device according to claim 2, wherein said signal transceiver is configured for receiving a sound signal wirelessly and transfer said sound signal to the speaker.

7. A device according to claim 1, wherein said vibration absorbing material is an elastic material.

8. A device according to claim 2, wherein said first portion of the sleeve is arranged to wrap around said speaker body leaving said speaker body holes exposed.

9. A device according to claim 1, wherein said mounting element is a suction cup.

* * * * *